US006729932B2

(12) United States Patent
Jarvis

(10) Patent No.: US 6,729,932 B2
(45) Date of Patent: May 4, 2004

(54) TOY WITH ILLUMINATED POLYHEDRON

(75) Inventor: Brian Marc Jarvis, Bristol, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/138,850

(22) Filed: May 3, 2002

(65) Prior Publication Data

US 2003/0207647 A1 Nov. 6, 2003

(51) Int. Cl.[7] ..... A63H 33/22

(52) U.S. Cl. ..... 446/219; 446/118; 40/547; 362/456

(58) Field of Search ..... 446/118, 124, 446/485, 125, 91, 219; 40/547; 362/456, 812; 273/237, 238, 241, 242

(56) References Cited

U.S. PATENT DOCUMENTS

| | | | | |
|---|---|---|---|---|
| 2,575,269 A | * | 11/1951 | Hall | |
| 3,067,536 A | | 12/1962 | Brittsan | |
| 3,530,615 A | * | 9/1970 | Meyer | |
| 3,568,357 A | * | 3/1971 | Lebensfeld | |
| 3,716,936 A | | 2/1973 | Miller | |
| 4,196,539 A | * | 4/1980 | Speers | 46/16 |
| 4,550,916 A | * | 11/1985 | Ortiz | 273/239 |
| 4,891,030 A | | 1/1990 | Gertzfeld | |
| 5,174,757 A | | 12/1992 | Jones | |
| 5,324,224 A | * | 6/1994 | Anderson et al. | 446/91 |
| 5,391,105 A | * | 2/1995 | Jones | 446/219 |
| 5,555,163 A | | 9/1996 | Pisani | |
| 5,876,262 A | | 3/1999 | Kelly et al. | |

* cited by examiner

*Primary Examiner*—Derris H. Banks
*Assistant Examiner*—Jamila Williams
(74) *Attorney, Agent, or Firm*—Marshall, Gerstein & Borun LLP

(57) ABSTRACT

An illumination toy may be provided having an illuminated polyhedron that may include a base and a plurality of apertured sides extending upwardly from the base. Each apertured side of the illuminated polyhedron may have a plurality of apertures. The illuminated polyhedron may further include an illumination source disposed between the apertured sides such that the illumination source provides simultaneous illumination to all of the plurality of apertured sides. The illumination toy may further include a plurality of translucent pegs, with the apertures of the apertured sides being adapted to receive the translucent pegs and retentively engage the translucent pegs. The illumination toy may also include a plurality of opaque sheets which the apertured sides are adapted to received, with the opaque sheets having indicia thereon corresponding to positions of at least some of the apertures of the apertured sides when the opaque sheets are disposed adjacent the apertured sides.

41 Claims, 5 Drawing Sheets

TOY WITH ILLUMINATED POLYHEDRON

BACKGROUND

The patent is directed to a toy, and more particularly to an illuminated polyhedron, such as a cube, having apertured sides with apertures into which colored translucent pegs are inserted to create designs.

Various illuminated toys and other light displays have been previously described. For example, U.S. Pat. No. 4,891,030 to Gertzfeld discloses a lighted construction toy that includes a light box with a translucent top. The top includes a plurality of upstanding pegs that are arranged in a grid pattern. A plurality of blocks have sockets on their underside which may be pressed down over the pegs on the top and also cover the pegs on the upper side of the blocks. All blocks are shaped and dimensioned to fit together in the formation of a variety of structures.

U.S. Pat. No. 5,555,163 to Pisani discloses a miniature light string display container for selectively displaying a plurality of light bulbs of a miniature light string in a desired arrangement. The light display includes a container with a front display panel having an array of regularly spaced mounting openings therethrough. The openings are sized for securely receiving light bulbs of a light string at least partially therethrough in a desired arrangement or pattern which is selectable on the array of mounting openings. The display container also includes a reversibly openable entry panel with a closed position and an open position in which the rear surface of the display panel may be accessed. Electrical connection wire is extendable through the display container, when closed, for connecting the string of lights to an electrical power source so that the pattern of inserted light bulbs is illuminated. In one embodiment, the light display container is pyramid-shaped, having a plurality of triangular-shaped display panels.

SUMMARY OF THE INVENTION

In one aspect, the invention is directed to an illuminated polyhedron for displaying a plurality of designs created by translucent pegs. The illuminated polyhedron may include a base and a plurality of apertured sides extending upwardly from the base. Each apertured side may have a plurality of apertures adapted to receive the translucent pegs and retentively engage the translucent pegs. The illuminated polyhedron may further include an illumination source disposed between the apertured sides such that the illumination source provides simultaneous illumination to all of the plurality of apertured sides.

The illuminated polyhedron may include a top disposed above the apertured sides and enclosing the interior of illuminated polyhedron, and a handle connected to the top. The illuminated polyhedron may further include supports connecting the base to the top, with the supports being disposed proximate the intersection of two of the apertured sides. Still further, the base of the illuminated polyhedron may include one or more openings on the sides of the base, with drawers adapted to store a plurality of the translucent pegs being disposed in the openings, and being slidable or pivotable within the slots to move between opened and closed positions.

In another aspect, the present invention is directed to an illumination toy for simultaneous use by a plurality of users. The illumination toy may include an illuminated polyhedron having a base and a plurality of apertured sides extending upwardly from the base, with each apertured side having a plurality of apertures. The illuminated polyhedron may further include an illumination source disposed between the apertured sides such that the illumination source provides simultaneous illumination to all of the plurality of apertured sides. The illumination toy may further include a plurality of translucent pegs, with the apertures of the apertured sides being adapted to receive the translucent pegs and retentively engage the translucent pegs.

The illumination toy may include a plurality of opaque sheets which the apertured sides are adapted to received, with the opaque sheets having indicia thereon corresponding to positions of at least some of the apertures of the apertured sides when the opaque sheets are disposed adjacent the apertured sides. The plurality of translucent pegs may have a plurality of colors, with each indicium of the opaque sheets corresponding to one of the plurality of colors. The illuminated polyhedron may include a top disposed above the apertured sides and enclosing the interior of illuminated polyhedron, and a handle connected to the top. The illuminated polyhedron of the illumination toy may further include supports connecting the base to the top, with the supports being disposed proximate the intersection of two of the apertured sides. Still further, the base of the illuminated polyhedron may include one or more openings on the sides of the base, with drawers adapted to store a plurality of the translucent pegs being disposed in the openings, and being slidable or pivotable within the slots to move between opened and closed positions.

Additional aspects of the invention are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
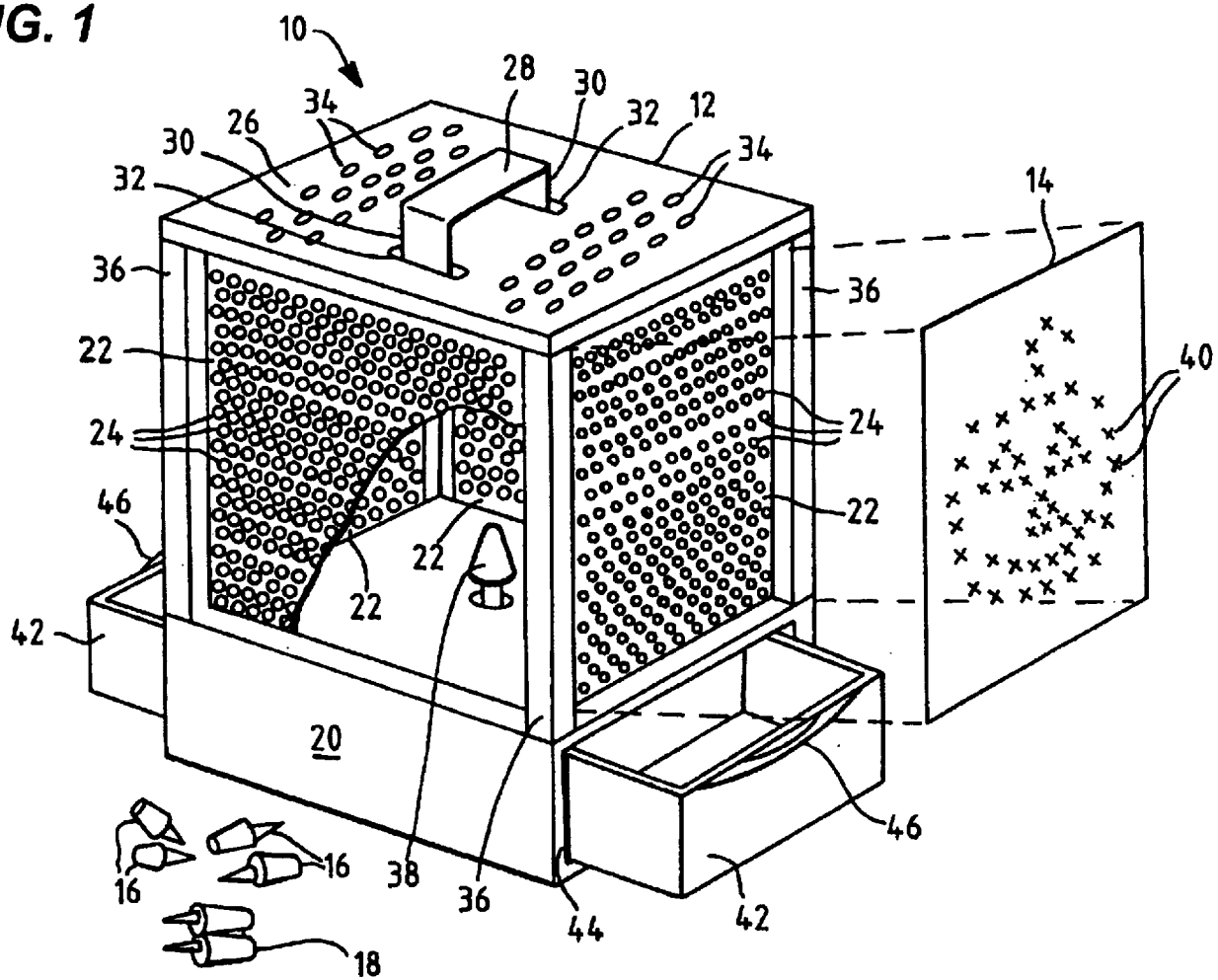
FIG. 1 is a perspective view of an embodiment of a toy with an illuminated polyhedron in accordance with the invention.

FIG. 1 illustrates one possible embodiment of a toy 10 in accordance with the invention. Referring to FIG. 1, the toy 10 may include an illuminated polyhedron, such as illuminated cube 12, one or more opaque sheets 14, and a plurality of translucent pegs 16, 18. The illuminated cube 12, which may sit on a surface such as a table or floor during use, may include a base 20 having a generally square shape with four square or rectangular apertured sides 22 extending upwardly proximate the edges of the base 20, thereby forming the side walls of the illuminated cube 12. In FIG. 1, one of the visible apertured sides 22 has been partially removed to reveal the inside of the illuminated cube including, among other things, the inner surfaces of the hidden apertured sides 22. Each of the apertured sides 22 may include a plurality of apertures 24 through which the inside of the illuminated cube 12 is visible from the outside, and vice versa. The apertures 24 may be arranged at regular spaced distances so that each aperture 24 is equidistant from the adjacent apertures 24. The apertures 24 may be configured in a two-dimensional array of apertures 24, in an offset pattern with alternate rows of apertures 24 being offset horizontally from the adjacent rows by half the distance separating adjacent apertures 24 within a row, or in any other configuration wherein a given aperture 24 is equidistant from the adjacent apertures. However, configurations of the apertures 24 wherein a given aperture 24 is not equidistant from each adjacent aperture 24 may be implemented in one or more of the apertured sides 22 of the illuminated cube 12.

The illuminated cube 12 may further include a generally square top 26 disposed above the apertured sides 22 and enclosing the interior of the illuminated cube 12. The upper edges of the apertured sides 22 engage the top 26 proximate the outer edges of the top 26. The top 26 may include a handle 28 having ends 30 disposed within slots 32 in the top 26. Configured in this way, the ends 30 may slide within the slots 32 to move the handle 28 between an extended carrying position and a retracted stored position. Alternatively, the handle 28 may have ends pivotally connected to the top 26 so that the handle 28 may rotate between the extended carrying position and the retracted stored position. The top 26 may further include a plurality of holes 34 through which the inside of the illuminated cube 12 is visible from the outside, and vice versa. The holes 34 may be provided for cosmetic and ventilation purposes. Alternatively, the holes 34 may be dimensioned and configured similar to the apertures 24 such that the holes 34 may engage and retain the pegs 16, 18 for creation of designs on the top 26.

In order to provide additional structural support, the illuminated cube 12 may further include a plurality of supports 36 extending between the base 20 and the top 26 of the illuminated cube 12. As shown in FIG. 1, vertical supports 36 may be disposed proximate the corners of the base 20 and the intersections of the apertured sides 22, and extend upwardly to the corresponding corners of the top 26. The base 20 and the top 26 may be secured to the supports 36 to form the illuminated cube 12, and the supports 36 may further engage the edges of the apertured sides 22 to prevent excessive deflection of the apertured sides 22 during use of the toy 10.

The illuminated cube 12 may be illuminated by having an illumination source, such as light bulb 38 disposed within the illuminated cube 12. The light bulb 38 may be mounted in and extend upwardly from the base 20 such that the light emitted from the light bulb 38 radiates toward the apertured sides 22 the top 26 of the illuminated cube 12. The light bulb 38 may be connected to batteries, or have a power cord (not shown) extending from the base 20 and connected to an electrical outlet. Lighting the light bulb 38, or any other illumination source, results in the simultaneous illumination of all the apertured sides 22 and, if holes 34 are provided, the top 26. The light from the illumination source passes through the apertures 24 and holes 34 and is visible from the outside of the illuminated cube 12. In addition to the light bulb 38, other types of illumination sources are contemplated. For example, the illumination source may be in the form of an array of light emitting diodes, or LEDs, configured to direct their light toward the apertured sides 22 and/or the top 26 for simultaneous illumination.

Figure 2:
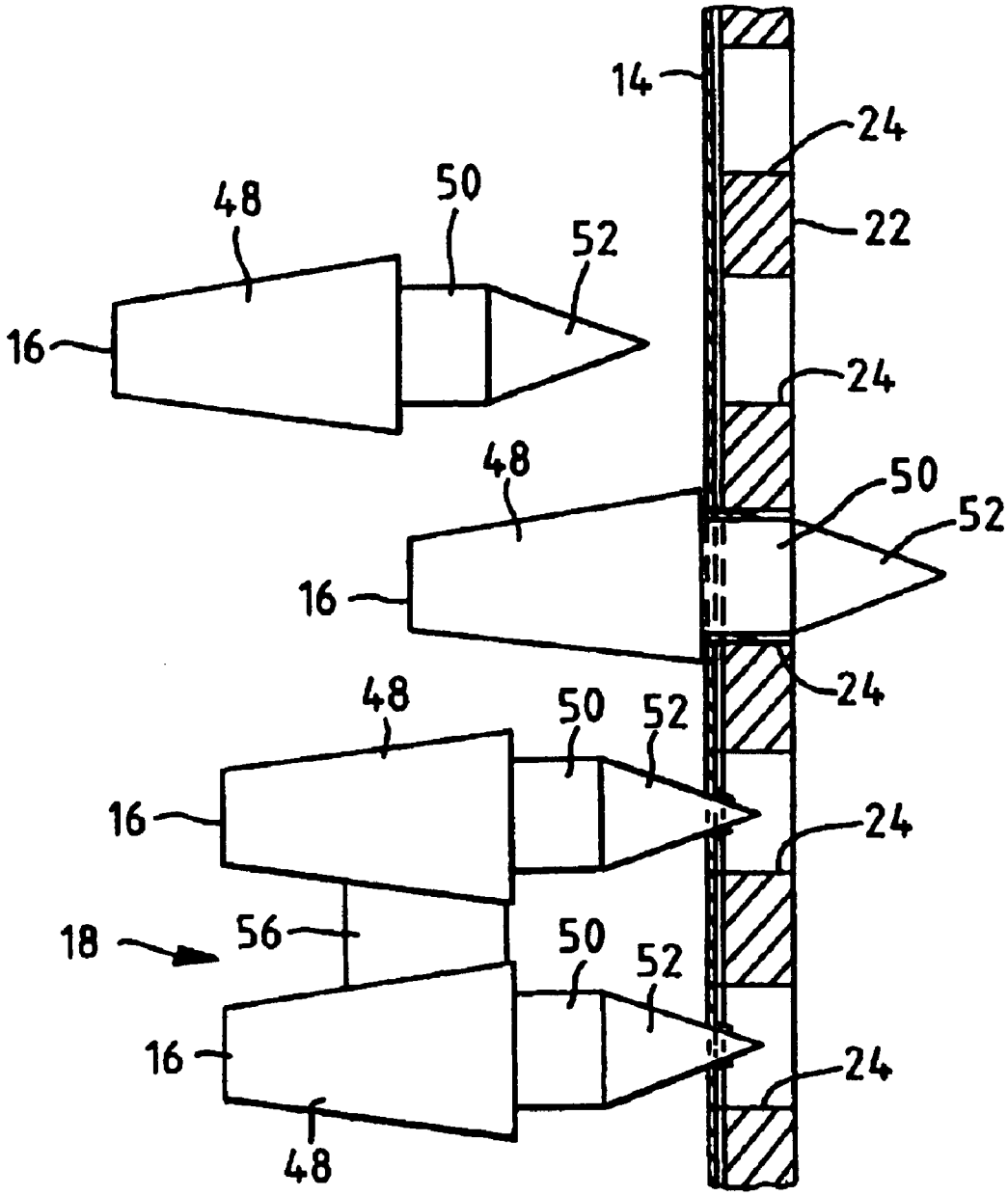
FIG. 2 is a partial cross-sectional view of one of the apertured sides of the illuminated polyhedron of FIG. 1.

In order to facilitate the creation and viewing of designs made by inserting translucent pegs 16, 18 into the apertures 24 in the manner more fully shown in FIG. 2 and described in the accompanying text, the opaque sheets 14 are placed against the outer surfaces of the apertured sides 22. The opaque sheets 14 block the light of the illumination source from the being viewed outside the illuminated cube 12, except at the spots that have been punctured by the translucent pegs during insertion into the apertures 24. To facilitate locating the underlying apertures 24 of the apertured sides 22, the opaque sheets 14 may include indicia 40 on the outer surface, with each indicium being positioned to correspond to the location of an aperture 24 of the apertured side 22 against which the opaque sheet 14 is disposed. The opaque sheets 14 may include indicia 40 corresponding to each aperture 24 of an apertured side 22, or may have indicia 40 corresponding to a subset of the apertures 24 of an apertured side 22 that are arranged in a pattern that results in the illuminated image of an object when pegs are inserted into the apertures 24 corresponding to the indicia 40 in the pattern. For example, the indicia 40 of opaque sheet 14 of FIG. 1 are arranged to form the image of a jack-o-lantern.

Because the illuminated cube 12 has a plurality of apertured sides 22 each having a plurality of apertures 24, a large number of translucent pegs 16, 18 are provided with the toy 10. To assist with keeping the components of the toy 10 together while the toy 10 in not in use, the base 20 of the illuminated cube 12 may include one or more drawers 42 for storing the pegs 16, 18. To accommodate the drawers 42, the base 20 may have openings 44 in the sides of the base 20. Each drawer 42 is disposed within a corresponding opening 44 of the base, and is slidable between an open position and a closed position, with handles 46 being provided for pulling the drawer 42 out of the opening 44. Alternatively, the drawers 42 may be pivotally connected at the bottom of the opening 44 and configured such that the drawers 42 tilt outward to an open position and tilt rearward to a closed position.

The translucent pegs 16, 18 and their insertion into the apertures 24 of the apertured sides 22 will now be discussed with reference to FIG. 2, wherein the same reference numerals are used to refer to the same elements previously identified. Single translucent pegs 16 may consist of a body 48, a cylindrical portion 50, and a conical portion 52. The body 48 of each peg 16 has an outer diameter that is greater than the inner diameter of the apertures 24 of the apertured sides 22, and the cylindrical portion 50 may have an outer diameter that is smaller than the inside diameter of the apertures 24 such that the inner surfaces of the apertures 24 retentively engage the cylindrical portion 50 of the peg 16 when the conical portion 54 and the cylindrical portion 52 are inserted into the apertures 24. As previously discussed, the opaque sheets 14 may have indicia 40 (not shown in FIG. 2) positioned to correspond to the location of a corresponding aperture 24.

To insert the peg 16, the tip of the conical portion 52 may be placed at one of the indicia 40 and the peg 16 may be pushed inward toward the illuminated cube 12. As the peg 16 moves inward, the conical portion 52 may puncture the opaque sheet 14 and move forward until the body 48 of the peg 16 engages the opaque sheet 14 and the apertured side 22. The inner diameter of the apertures 24 and the outer diameter of the cylindrical portion 50 may be dimensioned so that the surface of the apertures 24 retentively engage the cylindrical portion 50 of the peg 16 even when the punctured portion of the opaque sheet 14 is disposed between the components. After the pegs 16 have been inserted into the apertures 24, light from the illumination source may pass through the apertures 24 and corresponding punctures in the opaque sheet, thereby illuminating the translucent pegs 16, with the intact portions of the opaque sheet 14 blocking the light passing through the apertures 24 in which no pegs 16 have been inserted.

Multiple peg 18 shown in FIG. 2 may consist of two or more single pegs 16 having their bodies 48 connected by an intermediate web 54. The webs 56 may be dimensioned such that the distance between the connected single pegs 16 corresponds to the distance between adjacent apertures 24 of the apertured sides 22. Configured in this way, the conical portions 52 and cylindrical portions 50 of the single pegs 16 may be inserted simultaneously into the adjacent apertures 24.

Figure 3:
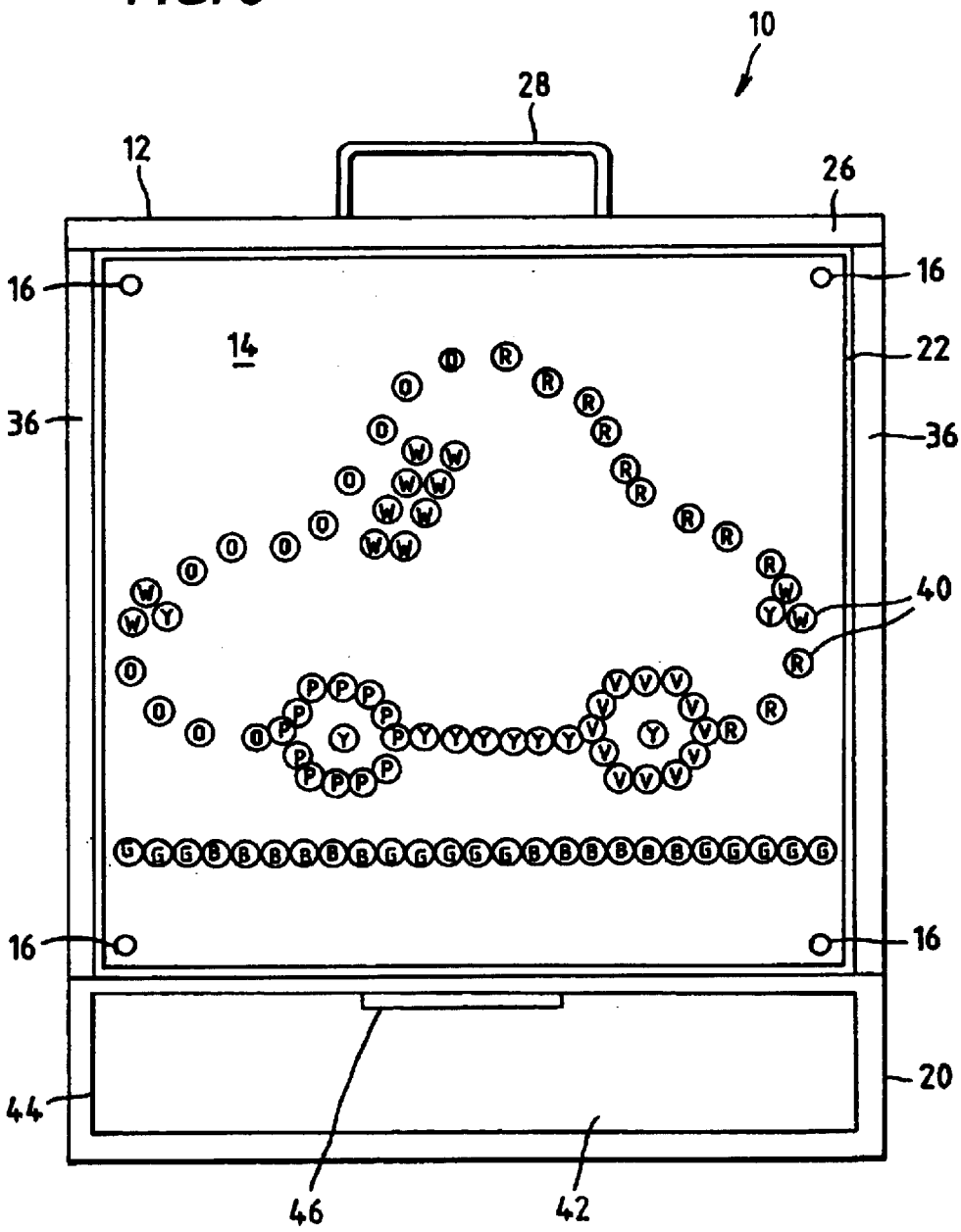
FIG. 3 is a front elevation view of the illuminated polyhedron of FIG. 1.

FIG. 3 illustrates the illuminated cube 12 having an opaque sheet 14 attached to the apertured side 22. In this embodiment, the opaque sheet 14 may be retained against the apertured side 22 by inserting pegs 16 into apertures 24 located at the corners of the apertured side 22. The indicia 40 on the opaque sheet 14 may be arranged in the shape of an automobile. The design of the opaque sheet 14, and thereby the toy 10, may be enhanced by using multiple colors of pegs 16, 18 to add color to the designs created with the pegs 16, 18. To identify the appropriate color pegs 16, 18 for the apertures 24 of the design, the indicia 40 on the opaque sheet 14 may indicate which color peg 16, 18 is to be inserted into a given aperture or apertures 24. For example, the following letters may be used as indicia 40 to identify the appropriate color pegs 16, 18:

W=white
B=blue
R=red
O=orange
P=pink
G=green
V=violet

By applying the colored pegs 16, 18 according to the indicia 40 on the opaque sheet 14, the design may result in a multi-colored automobile riding on a blue and green road.

Figure 4:
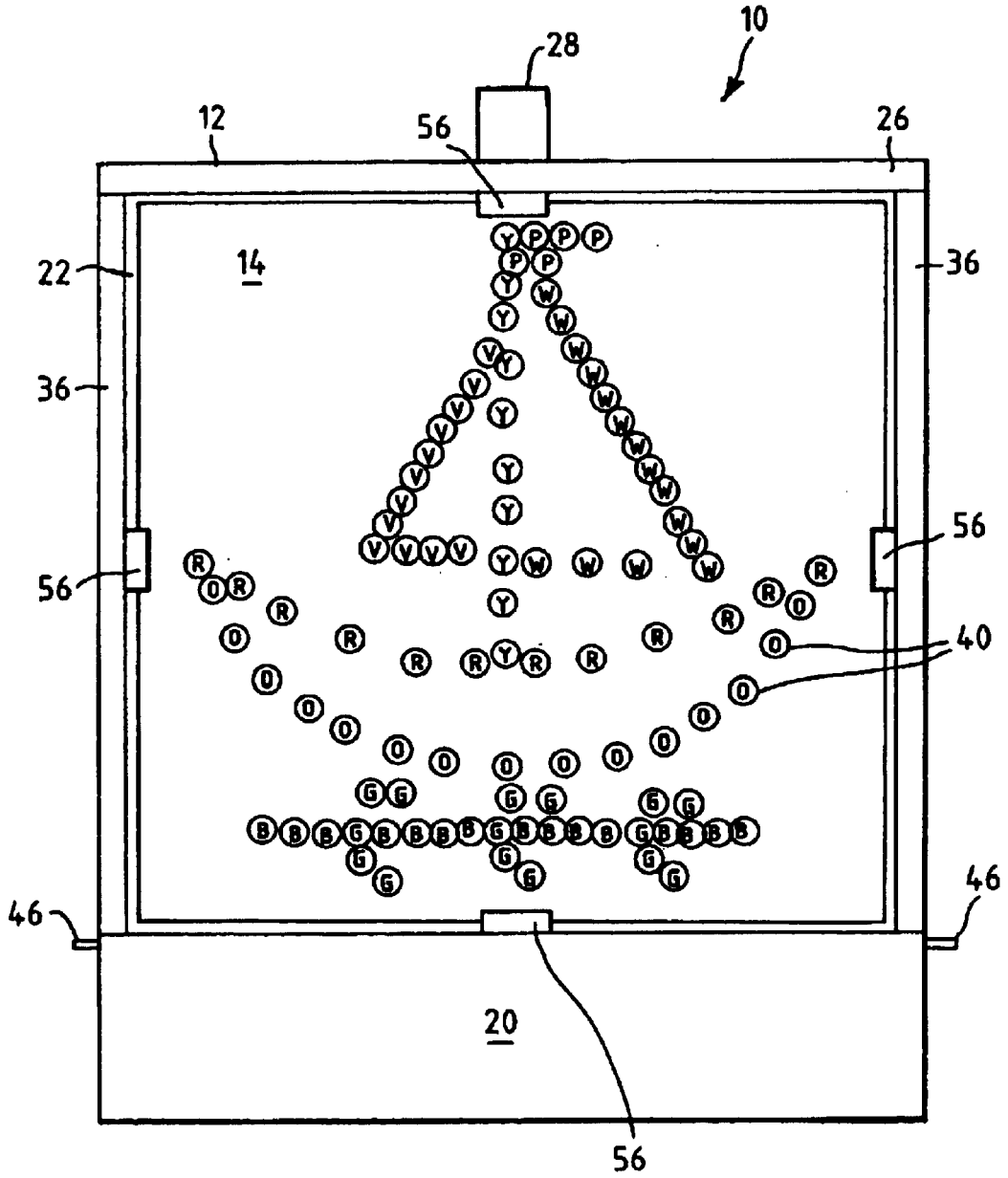
FIG. 4 is a side elevation view of an alternative embodiment the illuminated polyhedron of FIG. 1.

Referring now to FIG. 4, an alternative embodiment of an illuminated cube 12 may include a plurality of tabs 56 for holding the opaque sheets 14 against the apertured sides 22. The tabs 56 may extend out from the apertured sides 22 or, alternatively, from the base 20, the top 26 and the supports 36. The tabs 56 may spaced away from the surface of the apertured side 22 such that the edges of the opaque sheets 14 may be inserted between the surface of the apertured side 22 and the tabs 56 to retain the opaque sheets 14 against the surface of the apertured side 22. Once the design, which in this case is a sailboat, is complete and the pegs 16, 18 are removed, the edges of the opaque sheet 14 may be slid out from the tabs 56 and the opaque sheet 14 removed and replaced.

While the illuminated cube 12 illustrated in the drawing figures herein is a hexahedron having a generally cubic shape with four apertured sides 22, it will be understood that the toy 10 may have an illuminated polyhedron having any number of apertured sides 22, with the base 20 and/or the top 26 having corresponding geometries. For example, the toy 10 may have three apertured sides 22, with the base 20 and the top 26 having generally triangular shapes to form a pentahedron, or the three apertured sides 22 may be triangular shaped and converge to a point with the top 26 being omitted to form a quadrahedron or pyramid. Still further, the toy 10 may have an illuminated polyhedron having more than four apertured sides 22. Still further, while the apertured sides 22 are illustrated herein as being generally planar, the apertured sides 22 may have an associated curvature if desired (see FIG. 5).

What is claimed is:

1. An illuminated cube for displaying a plurality of designs created using translucent pegs, comprising:

a square base having a pair of openings disposed on opposite sides of the base;

four apertured sides extending upwardly from the base, each apertured side being disposed proximate and parallel to one of the edges of the base and having a plurality of apertures adapted to receive the translucent pegs and retentively engage the translucent pegs, each aperture of the apertured sides being equidistant from the apertures adjacent thereto;

a top disposed above the apertured sides and enclosing the interior of the illuminated cube;

a handle connected to the top;

four supports connecting the base to the top, each support being disposed proximate the intersection of two of the apertured sides;

a pair of drawers, each drawer being disposed in and slidable within one of the openings of the base and being adapted to store a plurality of the translucent pegs; and an illumination source disposed between the apertured sides such that the illumination source provides simultaneous illumination to all of the apertured sides.

2. An illuminated cube as defined in claim 1, wherein the top includes a pair of slots and the handle includes a pair of ends disposed in the slots and slidable between handle extended position and a handle retracted position.

3. An illuminated cube as defined in claim 1, wherein the top has a plurality of holes therethrough, and the illumination source provides simultaneous illumination to the top along with the apertured sides.

4. An illuminated cube as defined in claim 1, wherein the illumination source is a light bulb.

5. An illuminated cube as defined in claim 1, wherein the illumination source is mounted in and extends above the base.

6. An illuminated cube as defined in claim 1, wherein the apertured sides have curved surfaces.

7. An illumination toy for simultaneous use by a plurality of users, comprising:

an illuminated polyhedron having a base, a plurality of sides extending upwardly from the base, every side extending upwardly from the base having a plurality of apertures, and an illumination source disposed between the sides such that the illumination source provides simultaneous illumination to all of the plurality of sides; and a plurality of translucent pegs;

wherein the apertures of the plurality of sides are adapted to receive the translucent pegs and retentively engage the translucent pegs.

8. An illumination toy as defined in claim 7, wherein the illuminated polyhedron includes a top disposed above the sides and enclosing the interior of the illuminated polyhedron.

9. An illumination toy as defined in claim 7 further comprising a plurality of opaque sheets, the plurality of sides being adapted to receive the opaque sheets, the opaque sheets having indicia thereon corresponding to positions of at least some of the apertures on the sides when the opaque sheets are disposed adjacent the sides.

10. An illumination toy as defined in claim 9, wherein the apertures retentively engage the translucent pegs when the translucent pegs are pushed through the opaque sheets at the indicia.

11. An illumination toy as defined in claim 10, wherein the opaque sheets are retained on the plurality of sides by the plurality of translucent pegs when the translucent pegs are engaged by the apertures.

12. An illumination toy as defined in claim 9, wherein the translucent pegs have a plurality of colors and each indicium of the opaque sheets corresponds to one of the plurality of colors.

13. An illumination toy as defined in claim 9, wherein the sides each have a plurality of tabs being adapted to engage the opaque sheets to retain the opaque sheets adjacent the sides.

14. An illuminated polyhedron for displaying a plurality of designs created using translucent pegs, comprising:

a base;

a plurality of sides extending upwardly from the base, every side extending upwardly from the base having a plurality of apertures adapted to receive the translucent pegs and retentively engage the translucent pegs; and an illumination source disposed between the sides such that the illumination source provides simultaneous illumination to all of the plurality of sides.

15. An illuminated polyhedron as defined in claim 14 further comprising a top disposed above the sides and enclosing the interior of the illuminated polyhedron.

16. An illuminated polyhedron as defined in claim 15 further comprising a handle connected to the top of the illuminated polyhedron.

17. An illuminated polyhedron as defined in claim 16, wherein the top includes a pair of slots and the handle includes a pair of ends disposed in the slots and slidable between handle extended position and a handle refracted position.

18. An illuminated polyhedron as defined in claim 15, wherein the top has a plurality of holes therethrough, and the illumination source provides simultaneous illumination to the top along with the plurality of sides.

19. An illuminated polyhedron as defined in claim 15 further comprising a plurality of supports connecting the base to the top, each support being disposed proximate the intersection of two of the plurality of sides.

20. An illuminated polyhedron as defined in claim 14, wherein the base further includes an opening, the illuminated polyhedron further comprising a drawer disposed in and slidable within the opening of the base, the drawer being adapted to store a plurality of the translucent pegs therein.

21. An illuminated polyhedron as defined in claim 14, wherein the illumination source is a light bulb.

22. An illuminated polyhedron as defined in claim 14, wherein the illumination source is mounted in and extends above the base.

23. An illuminated polyhedron as defined in claim 14, wherein the plurality of sides comprises four sides.

24. An illuminated polyhedron as defined in claim 14, wherein the plurality of sides have curved surfaces.

25. An illuminated polyhedron as defined in claim 14, wherein each of the apertures of the plurality of sides are equidistant from the apertures adjacent thereto.

26. An illumination toy for simultaneous use by a plurality of users, comprising:

an illuminated cube comprising:

a square base having a pair of openings disposed on opposite sides of the base, four apertured sides extending upwardly from the base, each apertured side being disposed proximate and parallel to one of the edges of the base and having a plurality of apertures, each of the apertures of the plurality of apertured sides being equidistant from the apertures adjacent thereto, a top disposed above the apertured sides and enclosing the interior of the illuminated cube, a handle connected to the top of the illuminated cube, four supports connecting the base to the top, each support being disposed proximate the intersection of two of the apertured sides, a pair of drawers, each drawer being disposed in and slidable within one of the openings of the base, and an illumination source disposed between the apertured sides such that the illumination source provides simultaneous illumination to all of the plurality of apertured sides;

a plurality of opaque sheets, the apertured sides being adapted to receive the opaque sheets and the opaque sheets having indicia thereon corresponding to positions of at least some of the apertures on the apertured sides when the opaque sheets are disposed adjacent the apertured sides; and a plurality of translucent pegs having a plurality of colors and wherein each indicium of the opaque sheets corresponds to one of the plurality of colors;

wherein the apertures of to plurality of apertured sides are adapted to receive the translucent pegs and retentively engage the translucent pegs, and wherein the drawers are adapted to store a plurality of the translucent pegs therein.

27. An illumination toy as defined in claim 26, wherein the illumination source is a light bulb.

28. An illumination toy as defined in claim 26, wherein the plurality of apertured sides have curved surfaces.

29. An illumination toy as defined in claim 26, wherein the opaque sheets are retained on the plurality of apertured sides by the plurality of translucent peas when the translucent pegs are engaged by the apertures.

30. An illumination toy for simultaneous use by a plurality of users, comprising:

an illuminated polyhedron having a base, a plurality of sides extending upwardly from the base, every side extending upwardly from the base having an interactive activity disposed thereon, wherein at least one of the sides comprises an apertured side having a plurality of apertures, and an illumination source disposed between the sides such that the illumination source provides simultaneous illumination to all of the plurality of sides; and a plurality of translucent pegs;

wherein the apertures of the at least one apertured side are adapted to receive the translucent pegs and retentively engage the translucent pegs.

31. An illumination toy as defined in claim 30, wherein the illuminated polyhedron includes a top disposed above the sides and enclosing the interior of the illuminated polyhedron.

32. An illumination toy as defined in claim 30 further comprising a plurality of opaque sheets, the at least one apertured side being adapted to receive the opaque sheets, the opaque sheets having indicia thereon corresponding to positions of at least some of the apertures on the at least one apertured side when the opaque sheets are disposed adjacent the at least one apertured side.

33. An illumination toy as defined in claim 32, wherein the translucent pegs have a plurality of colors and each indicium of the opaque sheets corresponds to one of the plurality of colors.

34. An illumination toy as defined in claim 30, wherein each side comprises an apertured side having a plurality of apertures.

35. An illumination toy as defined in claim 30, wherein each side of the illuminated polyhedron is disposed substantially vertically.

36. An illumination toy for simultaneous use by a plurality of users, comprising:

an illuminated polyhedron having a base, a plurality of sides extending upwardly from the base and having a plurality of apertures, with each upwardly extending side having a plurality of apertures being disposed adjacent at least one other upwardly extending side having a plurality of apertures, and an illumination source disposed between the sides such that the illumination source provides simultaneous illumination to all of the plurality of sides; and a plurality of translucent pegs;

wherein the apertures of the plurality of sides are adapted to receive the translucent pegs and retentively engage the translucent pegs.

37. An illumination toy for simultaneous use by a plurality of users, comprising:

an illuminated polyhedron having a base, at least three sides extending upwardly from the base and having a plurality of apertures, and an illumination source disposed between the sides such that the illumination source provides simultaneous illumination to all of the plurality of sides; and a plurality of translucent pegs;

wherein the apertures of the plurality of sides are adapted to receive the translucent pegs and retentively engage the translucent pegs.

38. An illuminated polyhedron for displaying a plurality of designs created using translucent pegs, comprising:

a base;

a plurality of sides extending upwardly from the base and having a plurality of apertures adapted to receive the translucent pegs and retentively engage the translucent pegs, with each upwardly extending side having a plurality of apertures being disposed adjacent at least one other upwardly extending side having a plurality of apertures; and an illumination source disposed between the sides such that the illumination source provides simultaneous illumination to all of the plurality of sides.

39. An illuminated polyhedron for displaying a plurality of designs created using translucent pegs, comprising:

a base;

at least three sides extending upwardly from the base and having a plurality of apertures adapted to receive the translucent pegs and retentively engage the translucent pegs; and an illumination source disposed between the sides such that the illumination source provides simultaneous illumination to all of the plurality of sides.

40. An illumination toy for simultaneous use by a plurality of users, comprising:

an illuminated polyhedron having a base, a plurality of sides extending upwardly from the base and haying an interactive activity disposed thereon, wherein at least one of the upwardly extending sides comprises an apertured side having a plurality of apertures, and wherein each apertured side is disposed adjacent at least one other upwardly side having an interactive activity disposed thereon, and an illumination source disposed between the sides such that the illumination source provides simultaneous illumination to all of the plurality of sides; and a plurality of translucent pegs;

wherein the apertures of the at least one apertured side are adapted to receive the translucent pegs and retentively engage the translucent pegs.

41. An illumination toy for simultaneous use by a plurality of users, comprising:

an illuminated polyhedron having a base, at least three sides extending upwardly from the base and having an interactive activity disposed thereon, wherein at least one of the upwardly extending sides comprises an apertured side having a plurality of apertures, and an illumination source disposed between the sides such that the illumination source provides simultaneous illumination to all of the plurality of sides; and a plurality of translucent pegs;

wherein the apertures of the at least one apertured side are adapted to receive the translucent pegs and retentively engage the translucent pegs.

* * * * *

UNITED STATES PATENT AND TRADEMARK OFFICE

CERTIFICATE OF CORRECTION

PATENT NO. : 6,729,932 B2
DATED : May 4, 2004
INVENTOR(S) : Brian M. Jarvis

It is certified that error appears in the above-identified patent and that said Letters Patent is hereby corrected as shown below:

Title page,
Item [57], ABSTRACT,
Line 14, please delete "received," and insert -- receive, --.

Column 7,
Line 62, please delete "refracted" and insert -- retracted --.

Column 8,
Line 53, please delete "to plurality" and insert -- the plurality --.
Line 64, please delete "peas" and insert -- pegs --.

Signed and Sealed this

Thirty-first Day of August, 2004

JON W. DUDAS
*Director of the United States Patent and Trademark Office*

US006729932C1

(12) INTER PARTES REEXAMINATION CERTIFICATE (0262nd)

United States Patent
Jarvis

(10) Number: US 6,729,932 C1
(45) Certificate Issued: May 17, 2011

(54) TOY WITH ILLUMINATED POLYHEDRON

(75) Inventor: Brian Marc Jarvis, Bristol, RI (US)

(73) Assignee: Hasbro, Inc., Pawtucket, RI (US)

Reexamination Request:
No. 95/001,444, Sep. 10, 2010

Reexamination Certificate for:

| | |
|---|---|
| Patent No.: | **6,729,932** |
| Issued: | **May 4, 2004** |
| Appl. No.: | **10/138,850** |
| Filed: | **May 3, 2002** |

Certificate of Correction issued Aug. 31, 2004.

(51) Int. Cl.
*A63H 33/22* (2006.01)

(52) U.S. Cl. ..... 446/219; 446/118; 40/547; 362/456

(58) Field of Classification Search ..... 446/219
See application file for complete search history.

(56) References Cited

U.S. PATENT DOCUMENTS

| | | | |
|---|---|---|---|
| 4,276,705 | A | 7/1981 | Barth |
| 5,088,678 | A | 2/1992 | Bitan |
| 5,324,224 | A | 6/1994 | Anderson |
| 5,338,041 | A | 8/1994 | Jones |
| 5,876,262 | A | 3/1999 | Kelly |
| 5,984,755 | A | 11/1999 | Avey |
| 6,536,078 | B2 | 3/2003 | Tsai |

FOREIGN PATENT DOCUMENTS

| | | |
|---|---|---|
| EP | 107937 | 5/1984 |
| GB | 1186054 | 4/1970 |

*Primary Examiner*—Beverly M. Flanagan

(57) ABSTRACT

An illumination toy may be provided having an illuminated polyhedron that may include a base and a plurality of apertured sides extending upwardly from the base. Each apertured side of the illuminated polyhedron may have a plurality of apertures. The illuminated polyhedron may further include an illumination source disposed between the apertured sides such that the illumination source provides simultaneous illumination to all of the plurality of apertured sides. The illumination toy may further include a plurality of translucent pegs, with the apertures of the apertured sides being adapted to receive the translucent pegs and retentively engage the translucent pegs. The illumination toy may also include a plurality of opaque sheets which the apertured sides are adapted to receive, with the opaque sheets having indicia thereon corresponding to positions of at least some of the apertures of the apertured sides when the opaque sheets are disposed adjacent the apertured sides.

At the time of issuance and publication of this certificate, the patent remains subject to pending reissue application No. 11/130,438 filed May 16, 2005. The claim content of the patent may be subsequently revised if a reissue patent is issued from the reissue application.

At the time of issuance and publication of this certificate, the patent remains subject to pending reexamination control No. 95/000,098 filed Jun. 10, 2005. The claim content of the patent may be subsequently revised if a reexamination certificate issues from the reexamination proceeding.

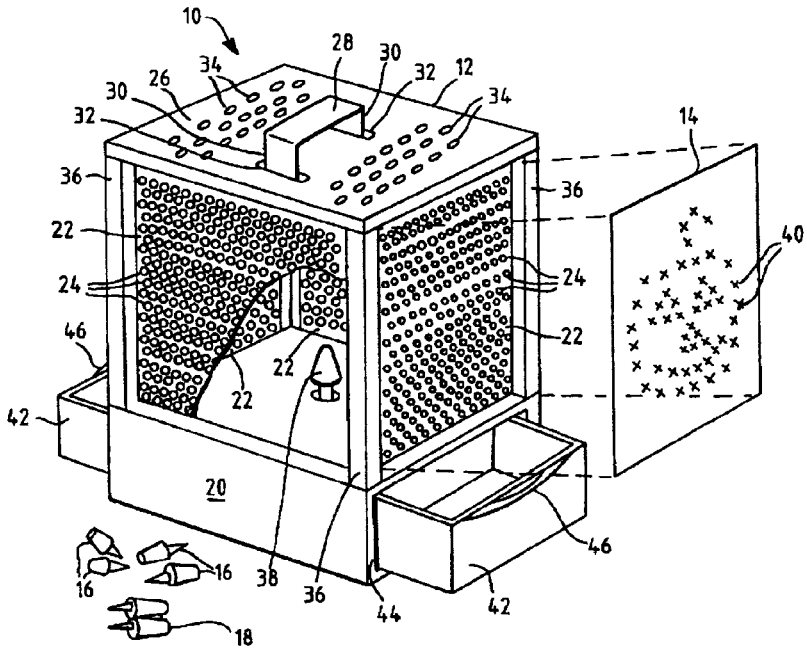

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-5, 19, 26, 27 and 29 are cancelled.

Claims 6-18, 20-25, 28 and 30-41 were not reexamined.

* * * * *

US006729932C2

(12) INTER PARTES REEXAMINATION CERTIFICATE (0319th)

United States Patent

Jarvis

(10) Number: US 6,729,932 C2

(45) Certificate Issued: Nov. 15, 2011

(54) TOY WITH ILLUMINATED POLYHEDRON

(75) Inventor: Brian Marc Jarvis, Bristol, RI (US)

(73) Assignee: Hasbro, Inc., Pawtucket, RI (US)

Reexamination Request:
No. 95/000,098, Jun. 10, 2005

Reexamination Certificate for:

| | |
|---|---|
| Patent No.: | **6,729,932** |
| Issued: | **May 4, 2004** |
| Appl. No.: | **10/138,850** |
| Filed: | **May 3, 2002** |

Reexamination Certificate C1 6,729,932 issued May 17, 2011

Certificate of Correction issued Aug. 31, 2004.

(51) Int. Cl.
*A63H 33/22* (2006.01)

(52) U.S. Cl. ..... 446/219; 446/118; 362/456; 40/547

(58) Field of Classification Search ..... 446/1, 446/91, 147, 175
See application file for complete search history.

(56) References Cited

To view the complete listing of prior art documents cited during the proceeding for Reexamination Control Number 95/000,098, please refer to the USPTO's public Patent Application Information Retrieval (PAIR) system under the Display References tab.

*Primary Examiner*—Beverly M. Flanagan

(57) ABSTRACT

An illumination toy may be provided having an illuminated polyhedron that may include a base and a plurality of apertured sides extending upwardly from the base. Each apertured side of the illuminated polyhedron may have a plurality of apertures. The illuminated polyhedron may further include an illumination source disposed between the apertured sides such that the illumination source provides simultaneous illumination to all of the plurality of apertured sides. The illumination toy may further include a plurality of translucent pegs, with the apertures of the apertured sides being adapted to receive the translucent pegs and retentively engage the translucent pegs. The illumination toy may also include a plurality of opaque sheets which the apertured sides are adapted to receive, with the opaque sheets having indicia thereon corresponding to positions of at least some of the apertures of the apertured sides when the opaque sheets are disposed adjacent the apertured sides.

At the time of issuance and publication of this certificate, the patent remains subject to pending reissue application number 11/130,438 filed May 16, 2005. The claim content of the patent may be subsequently revised if a reissue patent is issued from the reissue application.

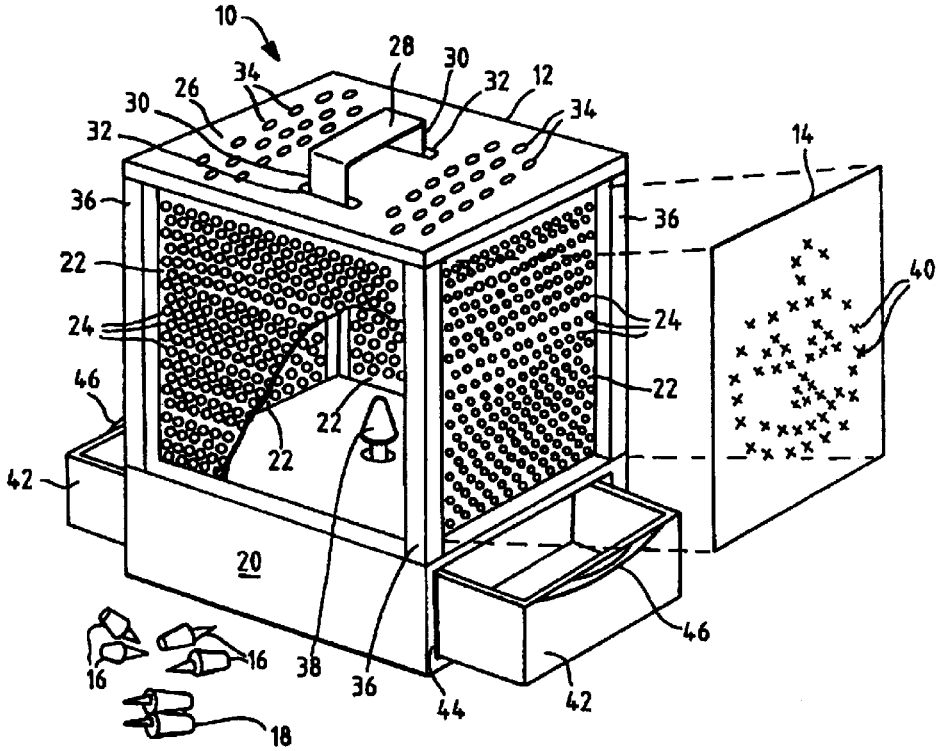

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Figure 5:
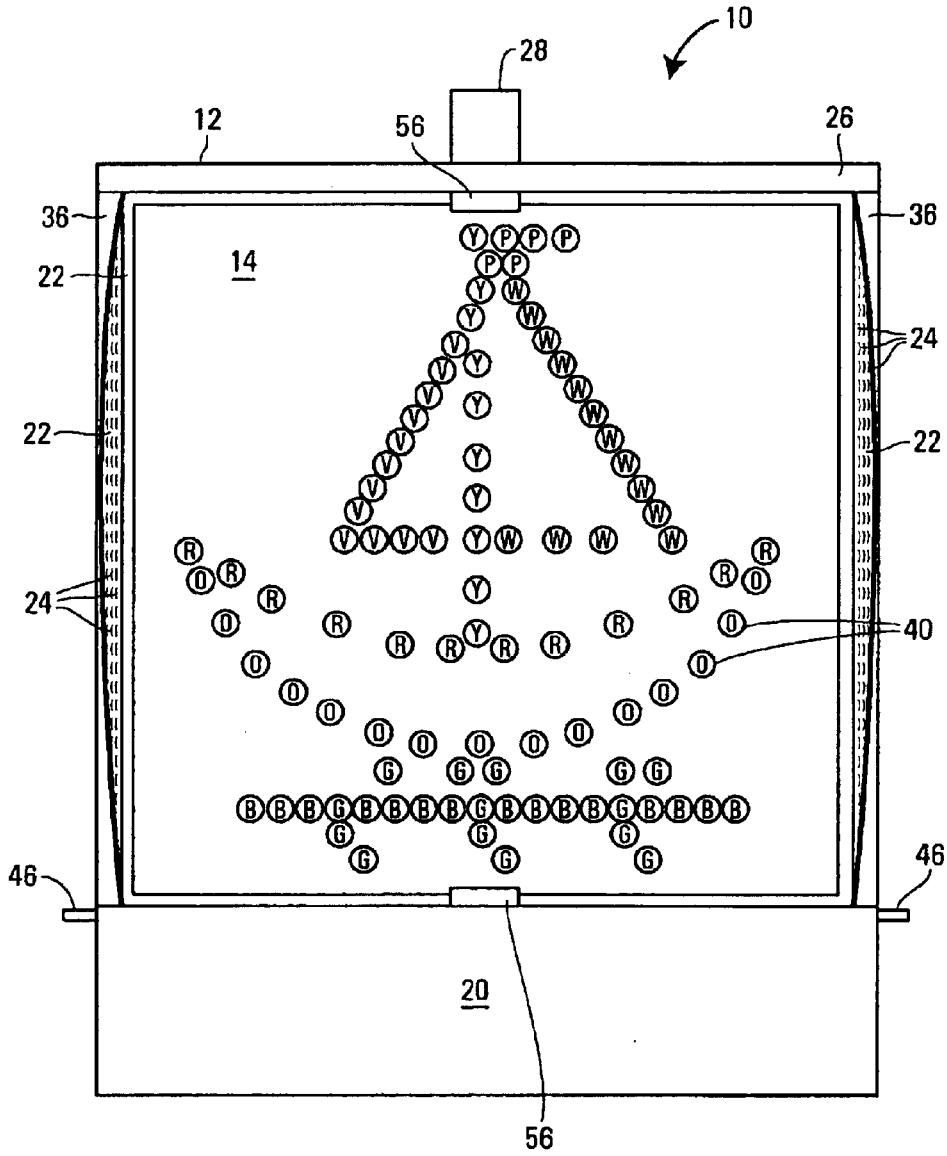
FIG. 5 is a side elevational view of a further embodiment of the illuminated polyhedron of FIG. 1 with the forward supports and tabs removed to reveal curved surfaces of the front and rear sides.

Column 2, lines 43-46:

[FIG. 5 is a side elevational view of a further embodiment of the illuminated polyhedron of FIG. 1 with the forward supports and tabs removed to reveal curved surfaces of the front and rear sides.]

Column 6, lines 13-28:

While the illuminated cube 12 illustrated in the drawing figures herein is a hexahedron having a generally cubic shape with four apertured sides 22, it will be understood that the toy 10 may have an illuminated polyhedron having any number of apertured sides 22, with the base 20 and/or the top 26 having corresponding geometries. For example, the toy 10 may have three apertured sides 22, with the base 20 and the top 26 having generally triangular shapes to form a pentahedron, or the three apertured sides 22 may be triangular shaped and converge to a point with the top 26 being omitted to form a quadrahedron or pyramid. Still further, the toy 10 may have an illuminated polyhedron having more than four apertured sides 22. Still further, while the apertured sides 22 are illustrated herein as being generally planar, the apertured sides 22 may have an associated curvature if desired [(see FIG. 5)].

THE DRAWING FIGURES HAVE BEEN CHANGED AS FOLLOWS:

FIG. 5 has been deleted.

AS A RESULT OF REEXAMINATION, IT HAS BEEN DETERMINED THAT:

Claims 1-5, 19, 26, 27 and 29 were previously cancelled.

Claims 6, 13, 16, 17, 20, 24, 28, 30-35, 40 and 41 are cancelled.

Claims 7, 9, 14 and 36-39 are determined to be patentable as amended.

Claims 8, 10-12, 15, 18, 21-23 and 25, dependent on an amended claim, are determined to be patentable.

New claims 42-44 are added and determined to be patentable.

7. An illumination toy for simultaneous use by a plurality of users, comprising:

an illuminated polyhedron having a base, a plurality of sides extending upwardly from the base, every side extending upwardly from the base having a plurality of apertures, and an illulmination source disposed between the sides such that the illumination source provides simultaneous illumination to all of the plurality of sides; and a plurality of translucent pegs;

wherein the apertures of the plurality of sides are adapted to receive the translucent pegs and retentively engage the translucent pegs, *and*

*wherein the illumination toy additionally comprises an opaque sheet, one of the plurality of sides being adapted to receive the opaque sheet, the opaque sheet having indicia thereon corresponding to positions of at least some of the apertures on the one side when the opaque sheet is disposed adjacent the one side.*

9. An illumination toy [as defined in claim 7 further comprising] *for simultaneous use by a plurality of users, comprising:*

*an illuminated polyhedron having a base, a plurality of sides extending upwardly from the base, every side extending upwardly from the base having a plurality of apertures, and an illumination source disposed between the sides such that the illumination source provides simultaneous illumination to all of the plurality of sides; and*

*a plurality of translucent pegs;*

*wherein the apertures of the plurality of sides are adapted to receive the translucent pegs and retentively engage the translucent pegs, and*

*wherein the illumination toy additionally comprises* a plurality of opaque sheets, the plurality of sides being adapted to receive the opaque sheets, the opaque sheets having indicia thereon corresponding to positions of at least some of the apertures on the sides when the opaque sheets are disposed adjacent the sides.

14. An illuminated polyhedron for displaying a plurality of designs created using translucent pegs, comprising:

a base;

a plurality of sides extending upwardly from the base, every side extending upwardly from the base having a plurality of apertures adapted to receive the transclucent pegs and retentively engage the translucent pegs; and an illumination source disposed between the sides such that the illumination source provides simultaneous illumination to all of the plurality of sides,

*wherein the illuminated polyhedron additionally comprises an opaque sheet, one of the plurality of sides being adapted to receive the opaque sheet, the opaque sheet having indicia thereon corresponding to positions of at least some of the apertures on the one side when the opaque sheet is disposed adjacent the one side.*

36. An illumination toy for simultaneous use by a plurality of users, comprising:

an illuminated polyhedron having a base; a plurality of sides extending upwardly from the base and having a plurality of apertures, with each upwardly extending side having a plurality of apertures being disposed adjacent at least one other upwardly extending side having a plurality of apertures, and an illumination source disposed between the sides such that the illumination source provides simultaneous illumination to all of the plurality of sides; and a plurality of translucent pegs;

wherein the apertures of the plurality of sides are adapted to receive the translucent pegs and retentively engage the translucent pegs, *and*

*wherein the illumination toy additionally comprises a plurality of opaque sheets, the apertured sides being adapted to receive the opaque sheets, the opaque sheets having indicia thereon corresponding to positions of at least some of the apertures on the plurality of apertured sides when the opaque sheets are disposed adjacent the apertured sides.*

37. An illumination toy for simultaneous use by a plurality of users, comprising:

an illuminated polyhedron having a base, at least three sides extending upwardly from the base and having a plurality of apertures, and an illumination source disposed between the sides such that the illumination source provides simultaneous illumination to all of the plurality of sides; and a plurality of translucent pegs;

wherein the apertures of the plurality of sides are adapted to receive the translucent pegs and retentively engage the translucent pegs, *and*

*wherein the illumination toy additionally comprises a plurality of opaque sheets, the apertured sides being adapted to receive the opaque sheets, the opaque sheets having indicia thereon corresponding to positions of at least some of the apertures on the plurality of apertured sides when the opaque sheets are disposed adjacent the apertured sides.*

38. An illuminated polyhdedron for displaying a plurality of designs created using translucent pegs, comprising:

a base;

a plurality of sides extending upwardly from the base and having a plurality of apertures adapted to receive the tranclucent pegs and retentively engage the translucent pegs, with each upwardly extending side having a plurality of apertures being disposed adjacent at least one other upwardly extending side having a plurality of apertures; and an illumination source disposed between the sides such that the illumination source provides simultaneous illumination to all of the plurality of sides,

*wherein the illuminated polyhedron additionally comprises a plurality of opaque sheets, the apertured sides being adapted to receive the opaque sheets, the opaque sheets having indicia thereon corresponding to positions of at least some of the apertures on the plurality of apertured sides when the opaque sheets are disposed adjacent the apertured sides.*

39. An illuminated polyhedron for displaying a plurality of designs created using translucent pegs, comprising:

a base;

at least three sides extending upwardly from the base and having a plurality of apertures adapted to receive the translucent pegs and retentively engage the translucent pegs; and an illumination source disposed between the sides such that the illumination source provides simultaneous illumination to all of the plurality of sides,

*wherein the illuminated polyhedron additionally comprises a plurality of opaque sheets, the apertured sides being adapted to receive the opaque sheets, the opaque sheets having indicia thereon corresponding to positions of at least some of the apertures on the apertured sides when the opaque sheets are disposed adjacent the apertured sides.*

*42. An illumination toy for simultaneous use by a plurality of users, comprising:*

*an illuminated polyhedron having a base, at least three sides extending upwardly from the base and having an interactive activity disposed thereon, wherein at least one of the upwardly extending sides comprises an apertured side having a plurality of apertures, and an illumination source disposed between the sides such that the illumination source provides simultaneous illumination to all of the plurality of sides; and*

*a plurality of translucent pegs,*

*wherein the apertures of the at least one apertured side are adapted to receive the translucent pegs and retentively engage the translucent pegs,*

*wherein the illumination toy additionally comprises a top and a handle connected to the top,*

*wherein the at least three sides comprise:*

*a first side having an upper portion disposed proximate a first portion of the top;*

*a second side having an upper portion disposed proximate a second portion of the top, the second side and the first side being disposed on opposite sides of the illuminated polyhedron;*

*a third side having an upper portion disposed proximate a third portion of the top; and*

*a fourth side having an upper portion disposed proximate a fourth portion of the top, the fourth side and the third side being disposed on opposite sides of the illuminated polyhedron;*

*wherein the illumination toy additionally comprises four supports connecting the base to the top, each support being disposed proximate the intersection of two of the sides,*

*wherein one of the four sides is recessed inwardly relative to a plurality of the supports,*

*wherein the illumination toy additionally comprises a pair of drawers, one of the drawers being disposed below the at least one apertured side and being sized to store a plurality of the translucent pegs therein,*

*wherein the illumination toy additionally comprises a plurality of opaque sheets, the at least one apertured side being adapted to receive the opaque sheets,*

*wherein the opaque sheets have indicia thereon corresponding to positions of at least some of the apertures of the at least one apertured side when the opaque sheets are disposed adjacent the at least one apertured side,*

*wherein the at least one apertured side has a shape and wherein the opaque sheets have a shape that is the same as the shape of the at least one apertured side,*

*wherein the translucent pegs have a plurality of colors and wherein each indicium of the opaque sheets corresponds to one of the colors of the translucent pegs.*

*43. An illumination toy as defined in claim 42 wherein each of the first, second, third and fourth sides has a plurality of apertures formed therein each of which is shaped to accommodate insertion of one of the translucent pegs.*

*44. An illumination toy as defined in claim 42 wherein the illuminated polyhedron is a cube.*

* * * * *